US007213271B1

(12) United States Patent
Bielefeld

(10) Patent No.: US 7,213,271 B1
(45) Date of Patent: May 8, 2007

(54) BROW PAD FOR THE HEADBAND OF PROTECTIVE HEADGEAR

(75) Inventor: Eric Bielefeld, Lexington, KY (US)

(73) Assignee: E.D. Bullard Company, Cynthiana, KY (US)

( * ) Notice: Subject to any disclaimer, the term of this patent is extended or adjusted under 35 U.S.C. 154(b) by 53 days.

(21) Appl. No.: 10/914,404

(22) Filed: Aug. 9, 2004

(51) Int. Cl.
*A42B 3/00* (2006.01)

(52) U.S. Cl. ..... 2/416; 2/181

(58) Field of Classification Search ..... 2/181, 2/183, 414, DIG. 11, 425, 416
See application file for complete search history.

(56) References Cited

U.S. PATENT DOCUMENTS

| | | | | |
|---|---|---|---|---|
| 758,806 | A | 5/1904 | Anderson | |
| 1,775,561 | A | 9/1930 | Kanner | |
| 2,445,209 | A * | 7/1948 | Clark | 2/181.4 |
| 3,089,146 | A * | 5/1963 | Sterne | 2/181 |
| 4,237,558 | A * | 12/1980 | Mackenroth et al. | 2/181 |
| 4,434,514 | A | 3/1984 | Sundahl et al. | |
| 4,502,156 | A | 3/1985 | Wishman | |
| 4,653,123 | A | 3/1987 | Broersma | |
| 4,910,804 | A * | 3/1990 | Lidgren | 2/209.3 |
| 5,025,504 | A | 6/1991 | Benston et al. | |
| 5,313,668 | A | 5/1994 | Bogan et al. | |
| 5,325,539 | A * | 7/1994 | Kronenberger | 2/195.2 |
| 5,327,585 | A | 7/1994 | Karlan | |
| 5,421,035 | A | 6/1995 | Klose et al. | |
| 5,946,734 | A | 9/1999 | Vogan | |
| 6,058,515 | A | 5/2000 | Kitahara | |
| 6,256,794 | B1 | 7/2001 | Erickson | |
| 6,564,390 | B2 * | 5/2003 | Vernon | 2/171 |
| 6,966,074 | B2 * | 11/2005 | Huh | 2/414 |

* cited by examiner

*Primary Examiner*—Katherine Moran
(74) *Attorney, Agent, or Firm*—Stites & Harbison, PLLC; David W. Nagle, Jr.

(57) ABSTRACT

A brow pad for the headband of a protective helmet or similar headgear is ultrasonically welded or similarly joined to itself through openings defined through the headband. By joining the brow pad to itself through the headband, the brow pad remains secured to the headband even after extensive usage. Furthermore, the openings defined through the headband provide some measure of ventilation and evacuation of accumulated moisture from the brow pad. Finally, by joining the brow pad to itself and through the headband, there are pockets of air that are trapped between the joined portions of the brow pad, which serve as air-filled "pillows," providing some measure of comfort to the wearer.

7 Claims, 3 Drawing Sheets

BROW PAD FOR THE HEADBAND OF PROTECTIVE HEADGEAR

BACKGROUND OF THE INVENTION

The present invention relates to a brow pad for the headband of a protective helmet or similar headgear.

Protective helmets are commonly worn in the industrial workplace to prevent or reduce the likelihood of head injuries. The hard hat is the most common and well-recognized protective helmet. A hard hat consists of three primary components—a shell, a headband, and a suspension system—which cooperate to reduce the potential for injury by attenuating some translational energy of the force of an impact to the helmet.

With respect to the construction and protection afforded by a hard hat, the American National Standards Institute ("ANSI") promulgates minimum performance requirements for protective helmets and further classifies helmets based on their ability to reduce the forces of impact and penetration, as well as their ability to protect against high voltage electric shock. See, for example, ANSI Z89.1-1997 (R1998), American National Standard for Industrial Head Protection.

As mentioned above, a hard hat or similar protective helmet is comprised primarily of: a shell, a headband, and a suspension system. These primary hard hat components cooperate to provide the requisite level of protection. The hard hat shell itself causes any force of impact to be spread across the surface area of the shell. The hard hat suspension separates the wearer's head from the shell such that there is an air gap between the shell and the wearer's head that provides for further attenuation of the force of an impact to the shell. Specifically, when an object strikes the shell of the hard hat, the shell itself flexes inward and the straps of the suspension system will stretch. The air gap accommodates the flexing of the shell and stretching of the straps, but, under normal conditions, prevents the wearer's head from contacting the hard hat shell.

Of course, for a hard hat to provide the appropriate level of protection, it must fit snugly on the wearer's head. In this regard, it is common for the headband of a hard hat to be adjustable to provide for such a snug fit. In this regard, a headband typically has one of two common sizing mechanisms, a pin-lock arrangement or a ratchet mechanism. Regardless of the chosen sizing mechanism, the headband is commonly a flexible, one-piece member that has overlapping rear end portions. With a pin-lock mechanism, a first of the rear end portions of the headband is provided with a pin, and the second of the rear end portions is provided with series of holes at spaced intervals. As such, the pin of the first rear end portion can be inserted through one of the holes of the second rear end portion, thus forming a loop of a selected circumference to fit snugly around the wearer's head. With a ratchet mechanism, lateral movement of the overlapping rear end portions of the headband is effectuated through a rack and pinion arrangement or similar gear arrangement.

As one example of a ratchet mechanism, reference is made to U.S. Pat. No. 4,888,831 issued to Oleson, a patent that is incorporated herein by this reference. As described in the '831 patent, a preferred ratchet mechanism is often a rack and pinion arrangement which operates within elongated overlapping slots defined by the rear end portions of the headband, each of said slots defining a series of teeth of a rack gear. The rack and pinion arrangement and the overlapping rear end portions of the headband are housed between a pair of adjoining arc-shaped housing sections which generally conform to the contour of the wearer's head. The rear end portions of the headband are seated for slidable, lateral movement within the arc-shaped housing sections.

For another example of a rack and pinion arrangement, reference is made to U.S. patent application Ser. No. 10/899,467, which is also incorporated herein by reference. Again, the rack and pinion arrangement and the overlapping rear end portions of the headband are housed between a pair of adjoining arc-shaped housing sections which generally conform to the contour of the wearer's head. The rear end portions of the headband are seated for slidable, lateral movement within the arc-shaped housing sections. Furthermore, as described in U.S. patent application Ser. No. 10/899,467, the arc-shaped housing sections have an inherent flexibility that provides for better fit of the headband and increased comfort to the wearer.

In any event, the focus of the present invention is on the brow pad, which is commonly secured to a front portion of the headband so that it contacts the wearer's forehead, providing increased comfort to the wearer and also serving to absorb perspiration. In securing the brow pad to the headband, a common technique is to provide the headband with integral tabs or cleats which are then inserted into corresponding holes through the brow pad. However, as the brow pad becomes worn, it may stretch or tear, and thus, become disengaged from the headband. Another common technique is to sew the brow pad directly to the headband. However, removing such a brow pad from the headband may prove difficult, if not impossible. Specifically, if an attempt is made to tear the brow pad from the headband, some of the brow pad fabric will undoubtedly remain, and furthermore, damage to the headband itself may result.

It would therefore be desirable to provide a brow pad for the headband of protective headgear that is secured to the headband in a manner that ensures that it will remain secured to the headband even after extensive usage, but still allows for removal and replacement of the brow pad if desired.

It would also be desirable to provide a brow pad for the headband of protective headgear that assists not only in absorbing perspiration, but also to draw perspiration and moisture away from the forehead of the wearer.

SUMMARY OF THE INVENTION

The present invention is a brow pad for the headband of a protective helmet or similar headgear, a brow pad that is ultrasonically welded or similarly joined to itself through openings defined through the headband.

A headband is incorporated into an article of protective headgear, such as a hard hat, helmet, respirator hood, or faceshield. According to the teachings of the present invention, the front portion of the headband includes a plurality of openings defined therethrough. To secure the brow pad to the headband, the brow pad is joined to itself through these openings, for example, by using ultrasonic welding techniques. By joining the brow pad to itself through the headband, the brow pad remains secured to the headband even after extensive usage. However, since the brow pad is not sewn to otherwise directly attached to the headband, it can still be removed without significant difficulty (i.e., by tearing or cutting) and without damaging the headband.

In addition to providing a means by which the brow pad can be joined to itself and secured to the headband, the openings provide some measure of ventilation and evacuation of accumulated moisture from the brow pad. Specifically, the brow pad will absorb perspiration from the wearer's forehead during use. Through a wicking or capillary action, moisture migrates from the moist area adjacent the wearer's forehead to the drier portion of the brow pad on the opposite side of the headband. Because the brow pad is joined to itself through the openings, there is a shorter path for the moisture to migrate to the opposite side of the headband. Once reaching this side, moisture will naturally evaporate into the ambient air.

Finally, by joining the brow pad to itself and through the headband, there are pockets of air that are trapped between the joined portions of the brow pad, which serve as air-filled "pillows," providing some measure of comfort to the wearer.

DESCRIPTION OF THE INVENTION

The present invention is a brow pad for the headband of a protective helmet or similar headgear, a brow pad that is ultrasonically welded or similarly joined to itself through openings defined through the headband.

Figure 1:
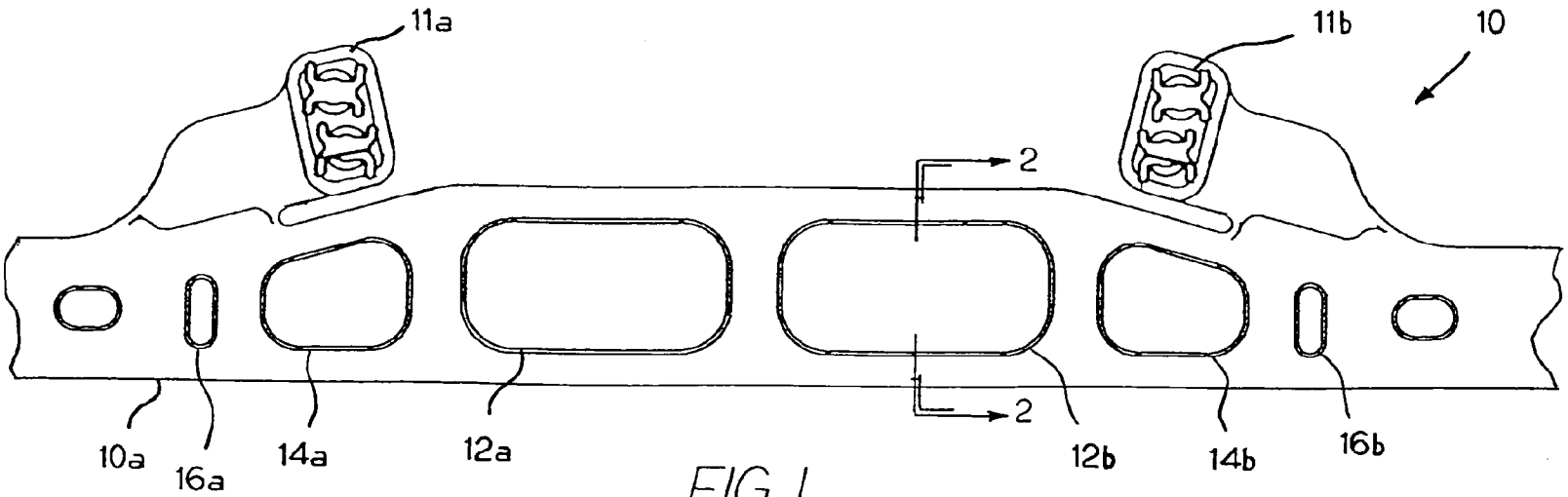
FIG. 1 is a plan view of the front portion of an exemplary headband.

FIG. 1 is a plan view of an exemplary headband 10, specifically illustrating the front portion 10*a* of the headband 10 that would be positioned adjacent the forehead of a wearer when the headband 10 is incorporated into an article of protective headgear, such as a hard hat, helmet, respirator hood, or faceshield. This exemplary headband 10 is designed for use with a hard hat. In this regard, the headband 10 includes a plurality of upwardly extending appendages 11*a*, 11*b* (two of which are illustrated in FIG. 1), with each such appendage 11*a*, 11 *b* being used to secure the headband 10 to the suspension of the hard hat. For further details regarding the incorporation of such a headband 10 into a protective helmet, reference is made to U.S. Pat. No. 6,609,254, which is incorporated herein by this reference.

More pertinent to the present invention, the front portion 10*a* of the headband 10 includes a plurality of openings defined therethrough. As illustrated in FIG. 1, in this exemplary embodiment, there are two substantially rectangular openings 12*a*, 12*b* with rounded corners in the center of the front portion 10*a* of the headband 10. There are then two substantially trapezoidal openings 14*a*, 14*b* with rounded corners on either side of the rectangular openings 12*a*, 12*b*. Finally, there are two vertically oriented and substantially ovular openings 16*a*, 16*b* on either side of the substantially trapezoidal openings 14*a*, 14*b*. Of course, although one particular geometry and layout of the openings is illustrated in FIG. 1, various other geometries and layouts are possible without departing from the spirit and scope of the present invention.

Figure 2:
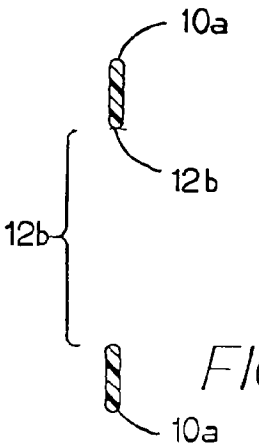
FIG. 2 is a sectional view of the exemplary headband of FIG. 1, taken along line 2—2 of FIG. 1.

FIG. 2 is sectional view of the front portion 10*a* of the exemplary headband 10 taken along line 2—2 of FIG. 1.

Figure 3:
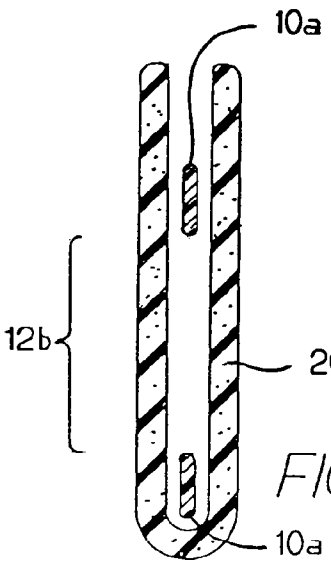
FIG. 3 is a sectional view similar to that of FIG. 2, illustrating the positioning of a brow pad around and adjacent to the exemplary headband of FIG. 1.

FIG. 3 is a sectional view similar to that of FIG. 2, illustrating the positioning of a brow pad 20 around and adjacent to the headband 10, with a first portion on one side of the headband and a second portion on an opposite side the headband. The brow pad 20 in this exemplary embodiment has a two-ply construction with (1) a layer of soft, absorbent material, such as an 50% polyester/50% cotton blend terry cloth material, which is adhered to (2) a polyester or polyurethane foam backing material. In this exemplary embodiment, the foam backing material is approximately 3/16 inches thick. Of course, various other fabrics and/or other materials could also be used to construct the brow pad 20 without departing from the spirit and scope of the present invention. In any event, and as illustrated in FIG. 3, to secure the brow pad 20 to the headband 10, the brow pad 20 is folded around the lower edge of the headband 10 into a U-shaped configuration.

Then, to secure the brow pad 20 to the headband 10, the brow pad 20 can be joined to itself through the openings 12*a*, 12*b*, 14*a*, 14*b*, 16*a*, 16*b* (as illustrated in FIG. 1) defined through the headband 10. For example, the joining of the brow pad 20 to itself can be accomplished using ultrasonic welding techniques. Ultrasonic welding employs high-frequency acoustic energy to essentially melt a thermoplastic at a desired location. Therefore, two parts (i.e., the brow pad 20 portions) can be pressed together and then ultrasonically welded in a predetermined pattern, such that the mating surfaces of the two parts are joined with a substantially insoluble connection. In this regard and as mentioned above, in this exemplary embodiment, the brow pad 20 in has a two-ply construction that includes a polyester or polyurethane foam backing material. It is this material that can be readily bonded using ultrasonic welding techniques. Accordingly, when the brow pad 20 is folded around the lower edge of the headband 10 into a U-shaped configuration, the foam backing layer is what contacts the headband 10 and is joined through the openings 12*a*, 12*b*, 14*a*, 14*b*, 16*a*, 16*b*.

Figure 4:
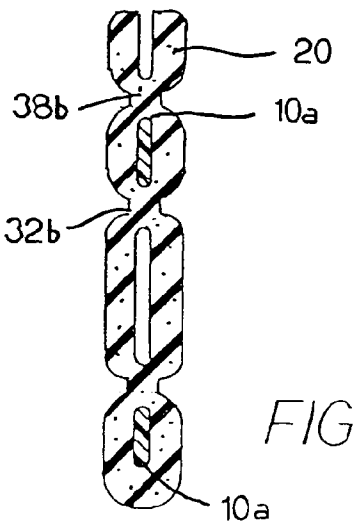
FIG. 4 is a sectional view similar to that of FIG. 2, illustrating the joining of the brow pad to itself around and adjacent to the exemplary headband of FIG. 1, a view that is taken along line 4—4 of FIG. 5.
Figure 5:
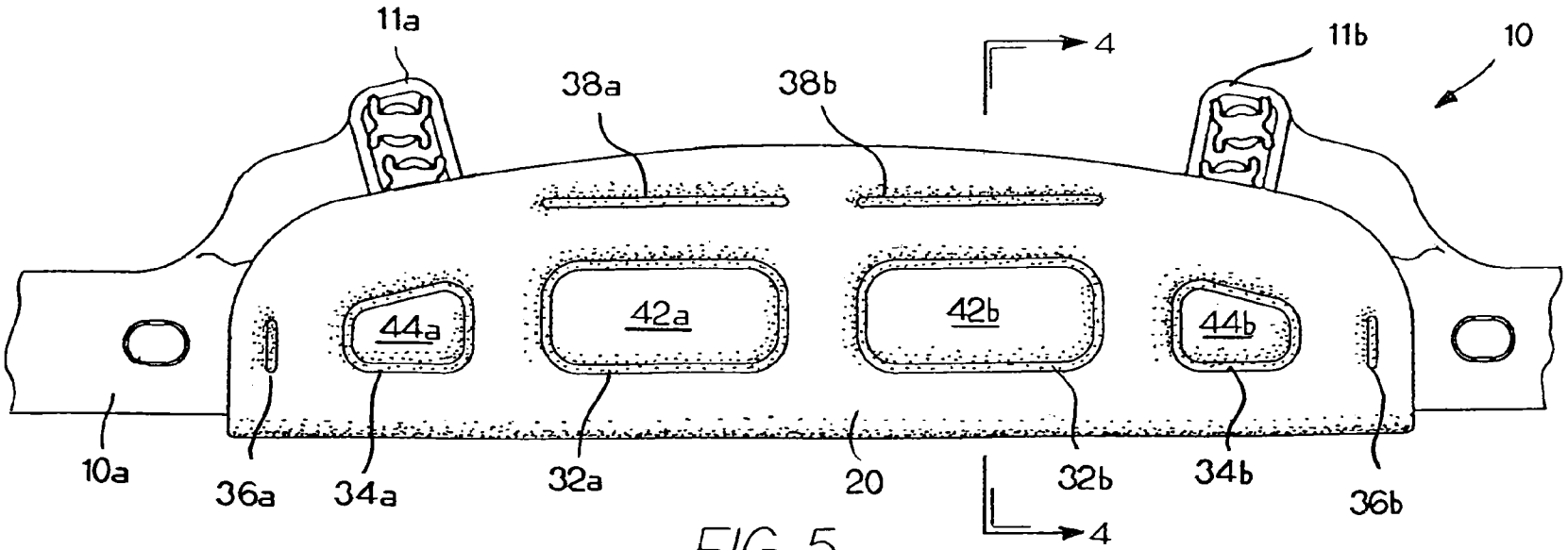
FIG. 5 is a plan view of the exemplary headband with the brow pad secured thereto, illustrating the side of the brow pad that contacts the forehead of the wearer.
Figure 6:
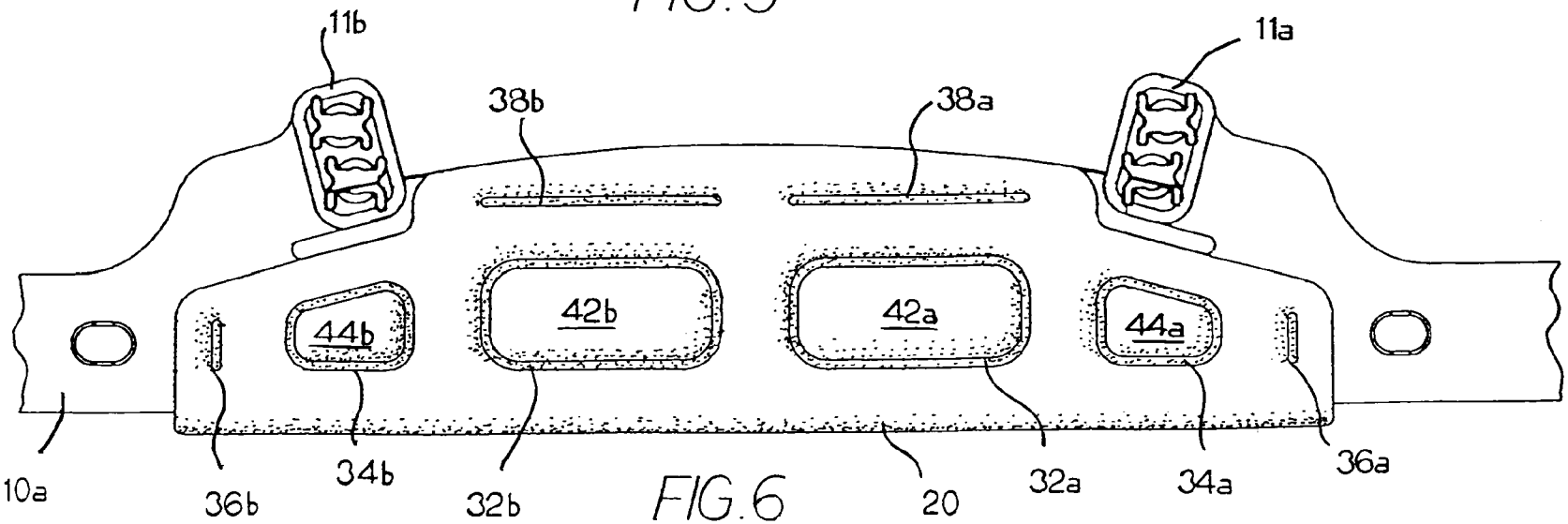
FIG. 6 is a plan view of the exemplary headband with the brow pad secured thereto, illustrating the side of the brow pad away from the wearer.

FIG. 4 is a sectional view similar to that of FIG. 2, illustrating the brow pad 20 welded to itself and secured to the headband 10. Specifically, and perhaps as best illustrated in FIGS. 5 and 6, the ultrasonic welding is performed in a pattern that closely mirrors the geometry of the openings 12*a*, 12*b*, 14*a*, 14*b*, 16*a*, 16*b* (as illustrated in FIG. 1) defined through the headband 10, with a weld width of approximately 1/16 inches. For example, substantially rectangular weld patterns 32*a*, 32*b* are used to join the headband 20 to itself through the two substantially rectangular openings 12*a*, 12*b* defined through the headband 10. Similarly, substantially trapezoidal patterns 34*a*, 34*b* are used to join the headband 20 to itself through the two substantially trapezoidal openings 14*a*, 14*b*. Lastly, because the ovular openings 16*a*, 16*b* are rather narrow in this exemplary embodiment, ultrasonic welds 36*a*, 36*b* are made in substantially vertical lines along the major axis of each opening 16*a*, 16*b*.

Furthermore, in this exemplary embodiment and referring still to FIGS. 4–6, two substantially horizontal welds 38*a*, 38*b* are made along the top edge of the headband 10.

Although ultrasonic welding may be an optimal technique for joining the brow pad 20 to itself through the openings 12*a*, 12*b*, 14*a*, 14*b*, 16*a*, 16*b*, thus securing the brow pad 20 to the headband 10, it should be understood and recognized that other joining techniques could be employed with departing from the spirit and scope of the present invention. Regardless of the specific technique used, however, by joining the brow pad 20 to itself through the headband 10, the brow pad 20 remains secured to the headband 10 even after extensive usage. However, since the brow pad 20 is not sewn to or otherwise directly attached to the headband 10, it can still be removed without significant difficulty (i.e., by tearing or cutting) and without damaging the headband 10.

In addition to providing a means by which the brow pad 20 can be joined to itself and secured to the headband 10, the openings 12*a*, 12*b*, 14*a*, 14*b*, 16*a*, 16*b* provide some measure of ventilation and evacuation of accumulated moisture from the brow pad 20. Specifically, the brow pad 20 will absorb perspiration from the wearer's forehead during use. Through a wicking or capillary action, moisture migrates from the moist area adjacent the wearer's forehead to the drier portion of the brow pad 20 on the opposite side of the headband 10. Because the brow pad 20 is joined to itself through the openings 12*a*, 12*b*, 14*a*, 14*b*, 16*a*, 16*b*, there is a shorter path for the moisture to migrate to the opposite side of the headband 10. Once reaching this side, moisture will naturally evaporate into the ambient air. Furthermore, to the extent that the brow pad 20 is constructed with a polymer-based foam, as in the exemplary embodiment described herein, the porosity of the brow pad 20 is optimal for absorbing perspiration.

Finally, by joining the brow pad 20 to itself and through the headband 10 in the manner described above, there are pockets of air that are trapped between the joined portions of the brow pad 20, which serve as air-filled "pillows." For example, as illustrated in FIGS. 5 and 6, along with the sectional view of FIG. 4, the substantially rectangular weld patterns 32*a*, 32*b* that are used to join the headband 20 to itself through the two substantially rectangular openings 12*a*, 12*b* result in two pillows, 42*a*, 42*b*, which provide some measure of comfort to the wearer. Similarly, the substantially trapezoidal weld patterns 34*a*, 34*b* result in two pillows, 44*a*, 44*b*, which also provide some measure of comfort to the wearer. To the extent that the brow pad 20 is constructed with a polymer-based foam, as in the exemplary embodiment described herein, the brow pad 20 will have a cushioning resiliency which enhances the comfort afforded by the pillows.

Figure 7:
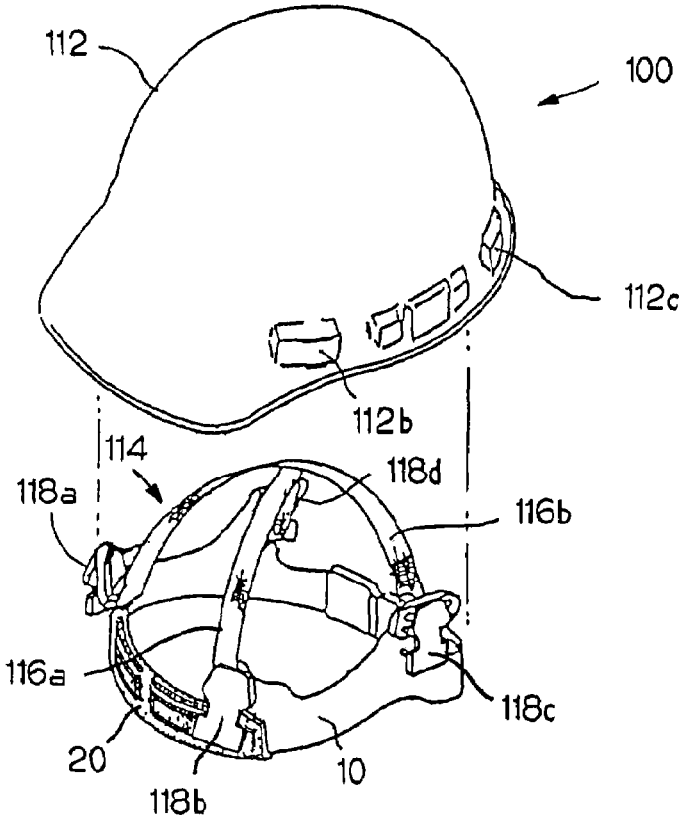
FIG. 7 is an exploded perspective view of a hard hat incorporating the exemplary headband and brow pad of FIGS. 1–6.
Figure 8:
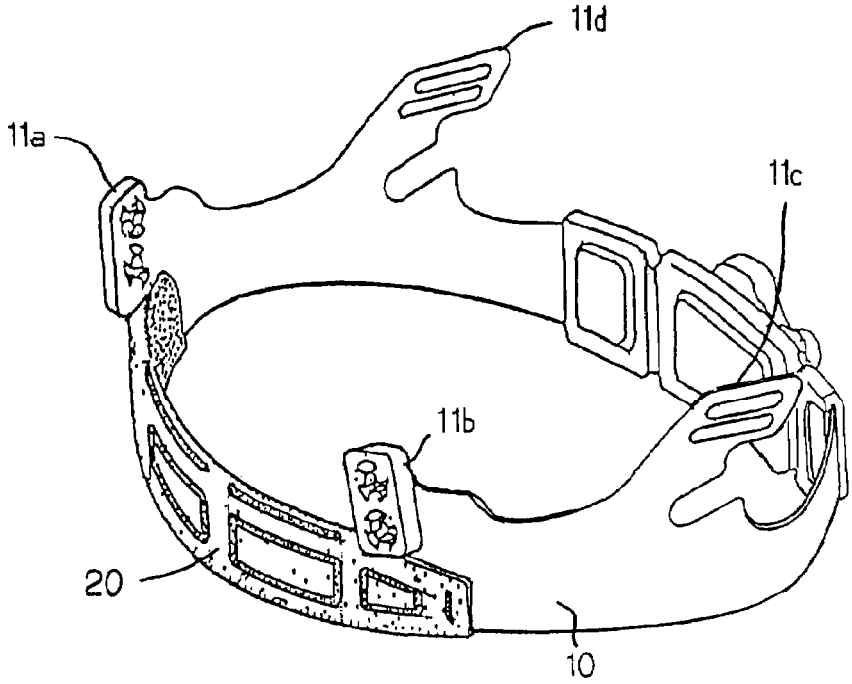
FIG. 8 is an enlarged perspective view of a portion of the exemplary headband and brow pad of FIG. 7.

FIG. 7 is an exploded perspective view of a hard hat 100 incorporating an exemplary headband 10 and brow pad 20 made in accordance with the present invention, and FIG. 8 is an enlarged perspective view of a portion of the exemplary headband 10 and brow pad 20 of FIG. 7. As illustrated in FIGS. 7 and 8, the hard hat 100 has a component shaped to protect the wearer's head, in this case, a substantially rigid shell 112. This shell 112 defines a bottom opening and an internal cavity for receiving the wearer's head. In this exemplary embodiment, the hard hat 100 has a 4-point suspension 114 comprising two intersecting straps 116*a*, 116*b*. A key 118*a*, 118*b*, 118*c*, 118*d* is secured to each end of each of the straps 116*a*, 116*b*. Thus, to secure the suspension 114 to the shell 112 of the hard hat 100, the shell 112 includes four key sockets spaced about the periphery of the shell 112, each such key socket being molded into the shell 112 and adapted to receive one of the keys (generally and collectively indicated by reference numeral 118). In this regard, key sockets 112*b* and 112*c* are illustrated and labeled in FIG. 7. It is contemplated and preferred that the keys 118 be constructed such that they can be "locked" into the key sockets. Furthermore, as best illustrated in FIG. 8 and mentioned above, the headband 10 has a plurality of upwardly extending appendages 11*a*, 11*b*, 11*c*, 11*d*. Each such appendage 11*a*, 11*b*, 11*c*, 11*d* corresponds with a respective key 118*a*, 118*b*, 118*c*, 118*d* of the suspension 114, such that the keys 118 can be secured to the headband 11.

Further details regarding the incorporation of the exemplary headband 10 and brow pad 20 into an article of protective headgear, such as a hard hat, can be found in U.S. Pat. No. 6,609,254 and U.S. patent application Ser. No. 10/899,467, each of which has been incorporated into the present application by reference.

It will be obvious to those skilled in the art that further modifications may be made to the embodiments described herein without departing from the spirit and scope of the present invention.

What is claimed is:

1. A protective helmet, comprising:

a substantially rigid shell shaped to protect a wearer's head, said shell defining a bottom opening and an internal cavity for receiving the wearer's head;

a headband adjacent the bottom opening of said shell and adapted to be worn around the wearer's head, said headband defining one or more openings through a front portion thereof;

a suspension secured to said headband and including at least two straps intersecting one another within the internal cavity of said shell near an apex of said shell; and a brow pad having a first portion on one side of the headband and a second portion on an opposite side the headband, said first portion and said second portion being joined to one another through said one or more openings through the front portion of the headband, securing the brow pad to the headband.

2. The protective helmet as recited in claim 1, wherein the respective first and second portions of the brow pad are joined to one another through ultrasonic welding.

3. The protective helmet as recited in claim 2, wherein each of said openings has a predetermined geometry, with a pattern for the ultrasonic welding closely mirroring the geometry of the respective openings.

4. The protective helmet as recited in claim 1, in which moisture absorbed by the first portion of the brow pad adjacent the head of the wearer migrates through said one or more openings to the second portion of the brow pad for subsequent evaporation into ambient air.

5. The protective helmet as recited in claim 1, in which air-filled pillows are created between the respective first and second portions of the brow pad, providing some measure of comfort to the wearer.

6. An article of protective headgear, comprising:

a component for protecting a wearer's head;

a headband secured to the component for protecting the wearer's head and adapted to be worn around the wearer's head, said headband defining one or more openings through a front portion thereof; and a brow pad having a first portion on one side of the headband and a second portion on an opposite side the headband, said first portion and said second portion being joined to one another through said one or more openings through the front portion of the headband, securing the brow pad to the headband.

7. The article of protective headgear as recited in claim 6, in which the component for protecting the wearer's head is a rigid shell.

* * * * *